United States Patent [19]

Lortie et al.

[11] Patent Number: 4,540,118

[45] Date of Patent: Sep. 10, 1985

[54] VARIABLE AIR VOLUME AIR CONDITIONING SYSTEM

[75] Inventors: Richard P. Lortie; William R. Adams, both of Winston-Salem, N.C.

[73] Assignee: R. J. Reynolds Tobacco Company, Winston-Salem, N.C.

[21] Appl. No.: 599,074

[22] Filed: Apr. 11, 1984

[51] Int. Cl.[3] ..... B01F 3/02; G05D 21/00

[52] U.S. Cl. ..... 236/44 C; 62/171; 62/176.4; 62/309; 261/DIG. 34; 165/19

[58] Field of Search ..... 236/44, 44 C, 44 R; 62/176.4, 171, 309; 165/19; 261/DIG. 34, 26, 28

[56] References Cited

U.S. PATENT DOCUMENTS 2,120,299 6/1938 Stramaglia ..... 261/DIG. 34

*Primary Examiner*—Henry Bennett

*Attorney, Agent, or Firm*—Herbert J. Bluhm

[57] ABSTRACT

A variable air volume air conditioning system is disclosed which is capable of accurately controlling temperature and humidity levels in a conditional zone while achieving significant economy of operation.

14 Claims, 2 Drawing Figures

VARIABLE AIR VOLUME AIR CONDITIONING SYSTEM

TECHNICAL FIELD

This invention relates to an air conditioning system designed to control accurately both temperature and humidity in a conditioned zone while variable volumes of air are circulated through the system.

BACKGROUND ART

The control of temperature and humidity in circulating air frequently involves the use of air washers for treating the air. The air washer is usually operated so that air leaving the air washer is cooled nearly to saturation at the required supply air dew point. When the cooling load of the comfort zone or work space being conditioned is less than the design load, the nearly saturated air is then reheated to the temperature required prior to delivery to the comfort zone or work space. Such an arrangement is wasteful of energy in that air recirculated from the comfort zone or work space involves energy usage for both the cooling and reheating treatments. The energy waste in this system can be reduced by employing a bypass which allows a portion of the return air to bypass the air washer spray section so that it does not undergo the cooling treatment. A bypass arrangement, however, is limited to approximately 30% of the return air because the resulting reduced air velocity of the remaining portion of the air stream passing through the air washer renders the moisture eliminator associated with the air washer less effective.

An alternative to the air washer bypass has been described wherein energy savings are realized by maintaining a non-saturated condition in the air leaving the air washer and the water spray in the air washer is modulated in response to the dry bulb temperature of the conditioned comfort zone or work space. This alternative reduces operating costs by eliminating a substantial proportion of the reheat requirements.

Another energy-saving arrangement which has been investigated involves a variable air volume conditioning system. Such systems are generally used in situations where temperature control in the conditioned comfort zone is of primary interest and the humidity control is not critical. Variable air volume systems are particularly attractive for installations having a number of comfort zones with different heating and cooling demands. These systems conserve energy by redistributing heating and cooling loads in the various comfort zones and by operating at reduced capacity during periods of low demand.

BRIEF SUMMARY OF INVENTION

This invention is directed to a variable air volume air conditioning system which provides uniform control of temperature and humidity levels in a conditioned work space while, at the same time, offering overall economy of operation. The system comprises an air washer for producing a stream of air that is substantially saturated with water at a predetermined dew point temperature through the use of an appropriate sensor which monitors the condition of the air leaving the air washer. The volume of air moving through the system is adjusted in response to demand in the conditioned work space as determined by pressure sensing means positioned in the air duct through which conditioned air flows to the work space. The demand for conditioned air is, in turn, determined by temperature sensing means located in the conditioned work space. During periods of heating and low cooling requirements, air flow through the system is maintained at reduced levels thereby resulting in reduced demand for electrical power, chilled water and steam. Operation at such reduced levels, however, does not impair the system's ability to control temperature and humidity levels accurately.

DETAILED DESCRIPTION OF THE INVENTION

Figure 1:
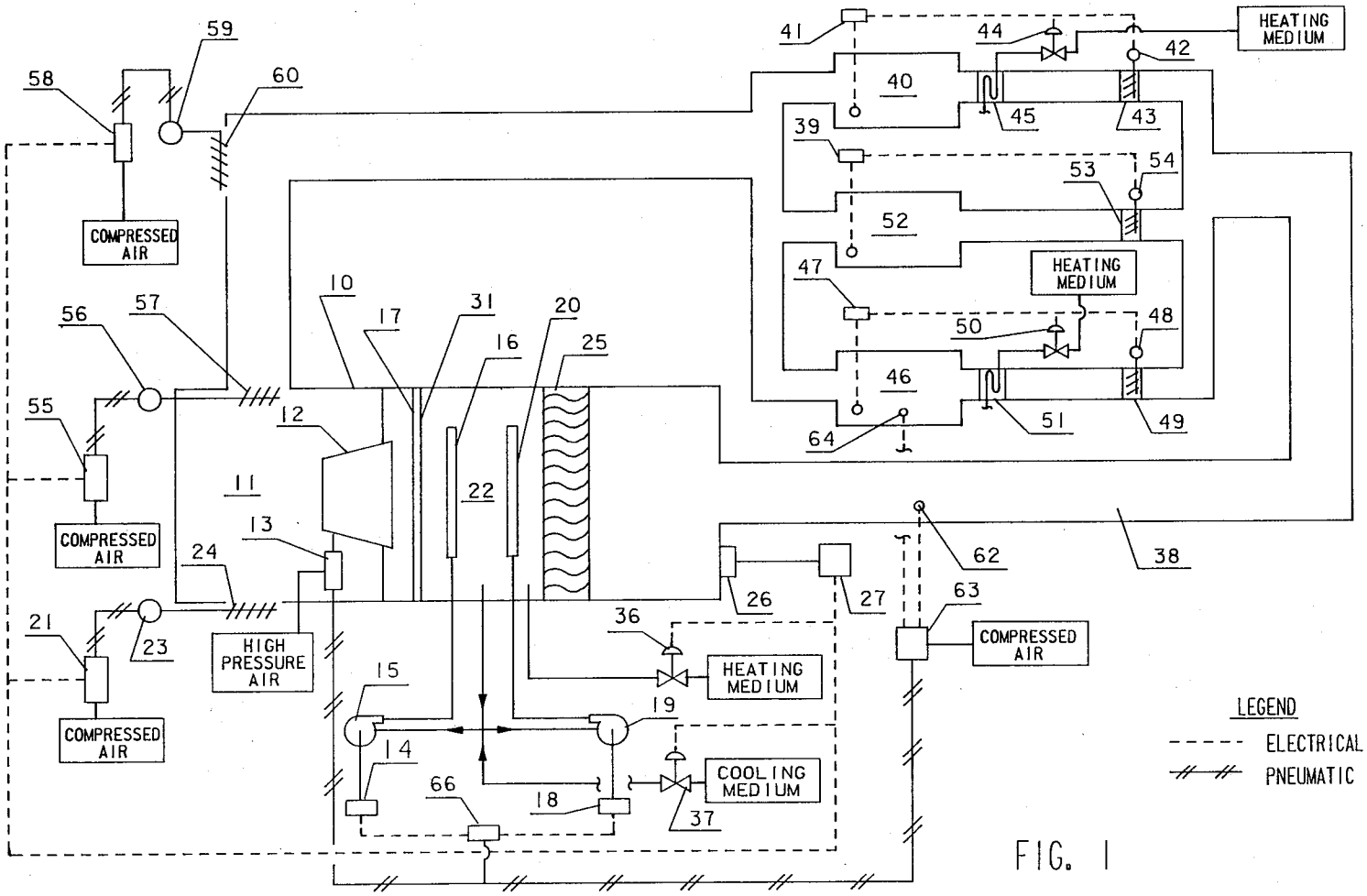
FIG. 1 is a schematic diagram of an improved air conditioning system in accordance with the present invention.

The present invention is an important air conditioning system based on variable air volume control which is capable of accurately maintaining both temperature and humidity levels in a conditioned comfort zone or work space. This system utilizes an air washer to provide an air stream leaving the air washer that is substantially saturated with water (i.e. at least 95%) and cooled or heated to the desired dew point temperature. The temperature of spray water injected into the air stream by the air washer is regulated by a sensor and associated controller which monitor the condition of the air leaving the air washer. The sensor and associated controller also modulate dampers which control the proportions of outside air and return air which are admitted into the air washer. A temperature sensor located in the conditioned zone is used to control damper means and heating means which regulate, respectively, the quantity and temperature of conditioned air admitted into the conditional zone.

A variable capacity fan is employed to move air through the air washer and the supply air duct which conveys the conditioned air to the comfort zone or work space. The capacity of the fan is regulated by a pressure controller associated with a pressure sensing device positioned within the supply air duct that conveys the conditioned air to the work space. As demand for conditioned air in the work space decreases, the resulting increase in static pressure within the supply air duct causes the pressure controller to reduce the capacity of the fan. The pressure controller also regulates the quantity of spray water injected into the air stream by the air washer so that a relatively constant air to water ratio is maintained as the fan capacity is varied.

Basically, then, the variable air volume system described herein for maintaining a conditioned zone at predetermined temperature and humidity levels comprises (a) a chamber having an entrance end provided with separate modulated damper means for admitting outside air and return air into the chamber and an exit end for delivering conditioned air to a supply air duct carrying conditioned air to said conditioned zone, (b) spray means positioned within the chamber intermediate the entrance and exit ends for spraying sufficient quantities of water into air moving through said chamber to deliver conditioned air to the supply air duct that is substantially saturated with water vapor and is adjusted to a predetermined temperature, (c) moisture eliminator means positioned within the chamber intermediate the spray means and said exit end for removing droplets of water entrained in the conditioned air, (d) variable capacity fan means for moving controlled volumes of air through said system per unit of time, (e) sensing means for monitoring the dew point of the conditioned air delivered to the supply air duct and control means associated therewith for modulating the damper means which admit outside air and return air into the chamber, (f) modulated supply air damper means located at the terminus of the supply air duct for admitting conditioned air into said conditioned zone, (g) heating means disposed in the supply air duct adjacent to the supply air damper means for heating the conditioned air, (h) temperature sensing means located in the conditioned zone and control means associated therewith for regulating said heating means and modulating said supply air damper means in response to temperature changes in said conditioned zone, and (i) pressure sensing means located in the supply air duct and control means associated therewith for modulating the capacity of said variable capacity fan and for regulating the quantity of water injected into the air by said spray means as the air moves through said chamber.

The presently disclosed system has been found to provide very accurate control of temperature and humidity in the conditioned work space. Thus, the temperature can be controlled within one Fahrenheit degree and the relative humidity can be controlled within three percent of the desired levels. Moreover, it has been found that substantial energy savings can be realized with this system by reducing the quantity of conditioned air that is supplied to the work space. The energy savings are possible because the system can be operated at reduced capacity for extended periods of time. Electrical power, chilled water and steam requirements are consequently lower during operation at reduced capacity. It is not uncommon for the system to operate at 50 percent of maximum capacity during periods of low demand. Although the system may be operated at capacities which are less than 50 percent of maximum, such operation is not entirely satisfactory because water droplets introduced into the moving air stream by the air washer are not efficiently removed by the moisture eliminator at the reduced air velocities which result from operation at less than 50 percent of design capacity.

The movement of air through the air washer may be accompanied by considerable turbulence which reduces the effectiveness of the spray water section and the moisture eliminator. It is desirable, therefore, to position a baffle plate in the path of the moving air stream immediately upstream of the water spray section to eliminate eddy currents in the air stream and to impart a uniform flow pattern to the air as it passes through the water spray section and moisture eliminator. Suitable baffle plates are known in the art and may, for example, take the form of a plate with a large number of uniformly spaced holes.

This invention is particularly suited to maintaining accurate temperature and humidity conditions in a plurality of confort zones or work spaces. The flow of conditioned air into each zone is controlled by zone damper means in response to a temperature controller which receives signals from a temperature sensor located in the respective zone. If heating of the conditioned air for a particular zone is required, the temperature controller may also be employed to regulate the means for heating the air delivered to that zone. For example, a reheat coil through which controlled amounts of steam or hot water flow may be utilized for this purpose. If desirable a single temperature controller may be utilized to control two or more zone damper means (and heating means, if necessary) for admitting conditioned air into a particular zone. The location of the temperature controller is not critical. In a preferred embodiment a remotely located programmable controller or microprocessor is employed to receive signals from the temperature sensors in the various comfort zones and to control the flow (and heating, if necessary) of conditioned air into each zone as required. The temperature controllers suitable for use may be the conventional proportional type; however, more precise temperature control can be achieved if the temperature controllers additionally possess integral or integral with derivative control capabilities. Where programmable controllers are employed, such controllers can also be utilized for other control loops in the system.

A preferred mode of operation for controlling temperatures in a plurality of conditioned zones involves temperature controllers programmed to permit the air flow required for maintaining the desired temperature in each zone during periods of maximum as well as minimum demands. Since the various zones may have widely differing demands, it is desirable to program the controller for each zone to match the supply of conditioned air to the anticipated demand for that zone. For example, a temperature controller for an outer perimeter zone may be programmed to modulate the supply air damper means between 50 and 100 percent of design air flow capacity whereas an interior zone may have its controller programmed to modulate its supply air damper means between 0 and 100 percent of design air flow capacity. In this example it is assumed that the outer perimeter zone has a greater continuing demand for conditioned air than does the interior zone. Maximum economy of operation is achieved by reducing air flow to each zone to minimum levels required for maintaining the desired temperatures. The supply air damper means are modulated to the fully open position when maximum cooling is required in the conditioned zone and are modulated to the partially closed or nearly closed position when heating is required in the zone. Minimum damper opening is also used for maintaining zone temperatures during periods of low cooling demand. During periods of maximum heating demands the temperature controller will, of course, modulate the heating means (e.g., reheat coil) to its maximum setting.

The variable capacity fan used with this invention should be capable of operating over a broad range of conditions so that reduced quantities of conditioned air can be moved during minumum cooling demand periods to make energy savings possible. The term "variable capacity fan" as used in this disclosure is intended to refer to any apparatus arrangement for varying the flow rate of air moving through the system including the use of variable speed motors, geared drive means provided with changeable gear ratios and fan housing means provided with adjustable inlet dampers. Preferably, however, the fan is provided with means for continuously adjusting the pitch of the fan blades in order to vary the volume of air moved per unit of time. The actuator which adjusts the fan capacity is conveniently controlled by a pneumatic or electronic signal transmitted by a static pressure controller which compares the static pressure sensed in the supply air duct with the pressure in the conditioned zone. As the fan capacity is varied in response to the static pressure in the supply air duct, it is necesssry to make a corresponding adjustment in the quantity of water sprayed into the moving air stream so that the air leaving the air washer is substantially saturated at all times but without a significant excess of water being introduced into the air stream. Therefore, the signal transmitted by the static pressure controller to the actuator for adjusting fan capacity is also employed for controlling water spray. This may be accomplished by suitable spray water pump means and flow diverting control valves installed in the water lines which deliver water to one or more spray nozzle assemblies. An alternative arrangement that is preferred employs a variable speed drive that is used to regulate the speed of the spray water pump means. This alternative arrangement permits the required quantities of water to be introduced into the moving air stream while spray pump brake horsepower is minimized. Additional economy of operation can be realized by employing at least two pumps to deliver water to at least two spray nozzle assemblies. By having each spray nozzle assembly supplied with water by its own pump, suitable control means can be used to provide for operation of only one of the pumps and its associated spray nozzle assembly during periods of low demand on the system. Also, it is preferred that water from the pumps be delivered to the upper ends of the spray nozzle assemblies and that the jets used for generating the spray pattern be of the opposed jet or impingement type. Such arrangements have been found to provide a more satisfactory spray pattern under the operating conditions normally encountered.

In addition to the control means which regulates the quantity of water injected into the air stream it is important that the air washer includes a moisture eliminator to remove water droplets entrained in the air stream. Such eliminators are routinely used in air washers and the particular design selected will depend on the velocity of the air stream. Eliminators designed to operate efficiently with air velocities of 300 to 700 feet per minute are typically used in conventional air washer systems and such eliminators are also suitable for use with the present invention provided that fan capacities of approximately 50 percent or more of design capacity are maintained during operation of the system. Maintaining air flow volume through the air washer above 50 percent of maximum volume capacity will ensure that air velocity through the eliminator will be maintained above the minimum required for efficient operation of the eliminator. If the system is to be operated at levels below 50 percent of maximum capacity, it is desirable to provide the moisture eliminator with means for selectively restricting air flow through a portion of the eliminator. Restricting air flow through a portion of the eliminator causes an increase in air velocity through the unrestricted portion of the eliminator thereby maintaining the air velocity within the velocity range recommended for the eliminator. It is preferred that this restriction of air flow be effected by one or more damper assemblies positioned adjacent to the exit side of the moisture eliminator so that the resulting air velocity through the unrestricted portion of the eliminator can be maintained within the range of air velocities recommended for the eliminator.

In order to achieve substantially complete saturation of the air stream passing through the air washer, the temperature of the spray water is preferably regulated in response to a dew point controller and associated sensing device which monitors the absolute humidity of the air leaving the air washer. Suitable heating and cooling means are provided to adjust the spray water temperature as required in response to the dew point controller. Air dampers through which outside air and return air (i.e., air returned from the conditioned work space or comfort zone) are admitted to the air washer are also preferably regulated by the dew point controller. Alternatively, the dew point of the air stream leaving the air washer may be maintained at the desired level by a temperature controller which controls the temperature of the spray water at the proper level to produce the desired humidity at the temperature level maintained in the conditioned zone. Preferably, the air conditioning system disclosed herein also includes "economizer cycle" means which permits outside air dampers to admit outside air into the air washer when outside air enthalpy is less than return air enthalpy so that "free cooling" can be realized.

A better understanding of the present invention will be obtained by consideration of the accompanying drawings discussed below.

Shown in FIG. 1 is a schematic diagram of a preferred arrangement for a variable air volume system in accordance with this invention. An air washer installed within enclosure 10 includes a variable capacity fan 12 for moving air through the system, baffle plate 17 confronting fan 12, water spray nozzle assemblies 16 and 20 with associated spray pumps 15 and 19, sump 22 for supplying spray pumps 15 and 19 with water that has been adjusted to the desired temperature, and moisture eliminator 25. Wall 31 of sump 22 extends a distance above the floor of enclosure 10 in order to provide an adequate quantity of water in sump 22. Conditioned air leaving enclosure 10 enters supply air duct 38 for routing to conditioned zones 40, 46 and 52. Temperature controllers 41, 47 and 39 and associated temperature sensors are connected respectively to damper actuators 42, 48 and 54 for modulating the positions of dampers 43, 49 and 53. If desired, suitable transducers and pneumatically operated damper actuators may be employed to modulate dampers 43, 49 and 53 in response to the electrical signals from temperature controllers 41, 47 and 39. Temperature controllers 41 and 47 are also connected to reheat coil control valves 44 and 50, respectively, for the purpose of heating the conditioned air by reheat coils 45 and 51. Zone 52 represents an interior zone which does not require a reheat coil under normal operating conditions. Return air from the conditioned zones is then routed to mixing chamber 11 via return air damper 57 where it is combined with outside air which enters mixing chamber 11 through outside air damper 24. The volume of outside air admitted is coordinated with a similar volume of return air expelled from the system through exhaust damper 60.

Located near the junction of enclosure 10 and supply air duct 38 is dew point sensing device 26 and associated dew point controller 27. Dew point controller 27 is connected to transducers 21, 55 and 58 which convert the electrical signals to pneumatic signals for operation of the respective damper actuators 23, 56 and 59 thereby controlling the flow of return air and outside air into mixing chamber 11. In addition, dew point controller 27 is connected to control valves 36 and 37 for regulating the flow of heating and cooling media, respectively, for the purpose of adjusting the spray water temperature as needed for maintaining the desired humidity levels in the air entering supply air duct 38. Under normal operating conditions the air entering supply air duct 38 is substantially saturated (i.e., at least 95 percent and preferably at least 97 percent) with water vapor.

The volume of air being moved through the system is controlled by varying the pitch of the blades on fan 12. Fan blade positioner 13 regulates the pitch of the blades in response to a pneumatic signal from pressure controller 63. Pressure controller 63 receives signals from pressure sensor 62 located in supply air duct 38 and pressure sensor 64 in conditioned zone 46 in order to generate a differential pressure signal. Sensor 64 may also be located in one of the other conditioned zones since the pressure prevailing in the various zones will normally be essentially the same. Fan blade positioner 13 is also provided with a source of high pressure air (e.g., 80 pounds per square inch) for operation of the pitch-adjusting mechanism on the fan blade. In addition to controlling fan blade positioner 13, pressure controller 63 also transmits a pneumatic signal to transducer 66 which converts the pneumatic signal to an electrical signal that regulates the output of spray pumps 15 and 19 by means of variable speed drives 14 and 18, respectively. By controlling both the fan capacity and the spray pump capacity from the same signal transmitted by pressure controller 63, a substantially constant air volume to water ratio is maintained.

Figure 2:
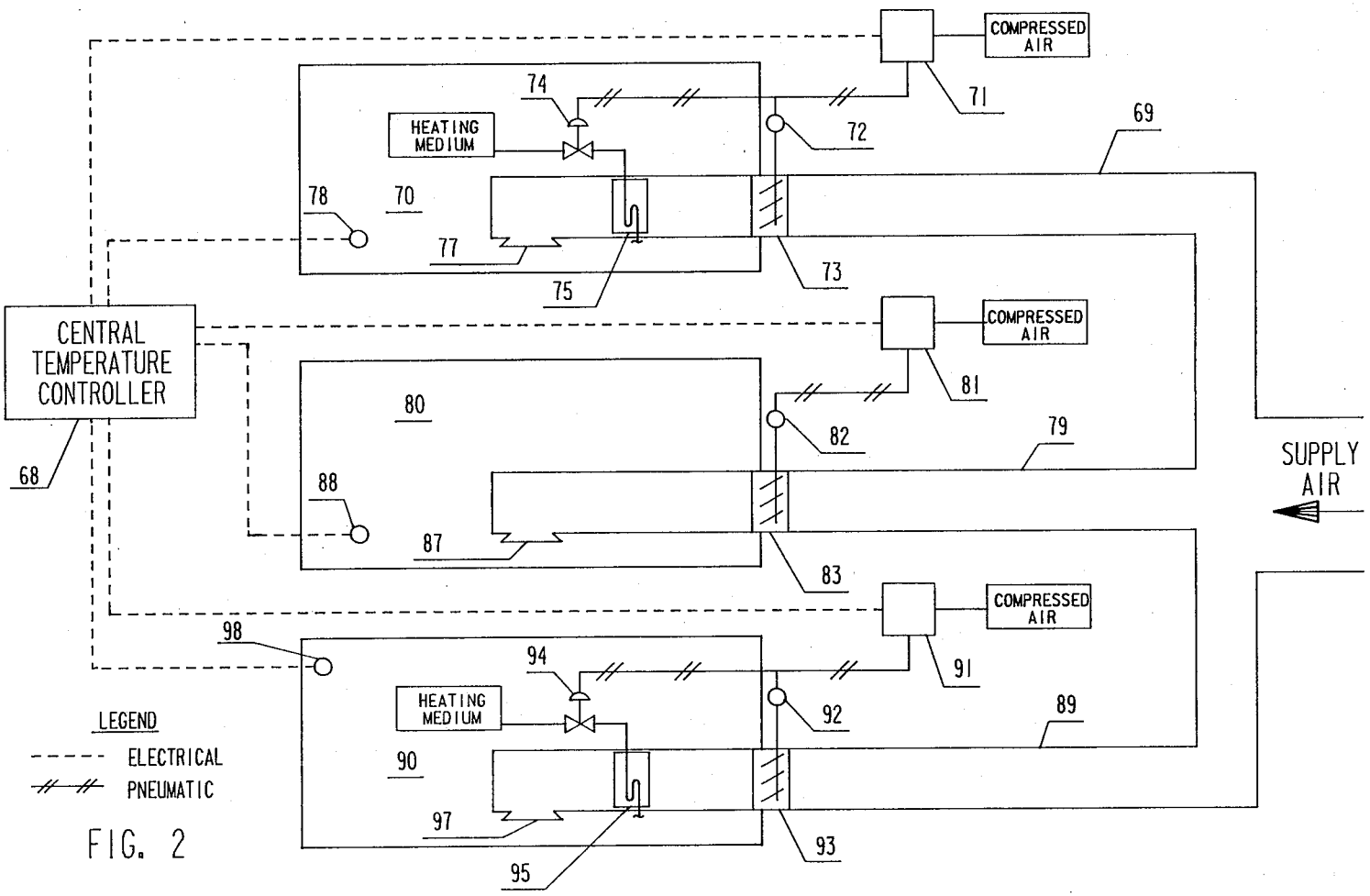
FIG. 2 is a schematic diagram of a portion of an air conditioning system showing the supply of conditioned air to a plurality of comfort zones.

FIG. 2 is a schematic diagram of a portion of an air conditioning system showing an alternative arrangement for controlling the flow of conditioned air into three comfort zones or work spaces. Comfort zones 70, 80 and 90 are provided, respectively, with temperature sensors 78, 88 and 98 which transmit temperature signals to a central programmable temperature controller 68. Temperature controller 68 is preferably provided with proportional or proportional with integral and/or derivative control capabilities in accordance with techniques already known in the art. Conditioned air is directed to each of zones 70, 80 and 90 via supply air ducts 69, 79 and 89 and air diffusers 77, 87 and 97, respectively. The flow rate of conditioned air to each comfort zone is controlled by supply air dampers 73, 83 and 93 and respective associated damper actuators 72, 82 and 92 in response to signals from temperature controller 68. Transducers 71, 81 and 91 receive electrical signals from temperature controller 68 and convert the electrical signals to pneumatic signals for operation of pneumatic damper actuators 72, 82 and 92, respectively. Supply air ducts 69 and 89 are provided with reheat coils 75 and 95, respectively, for heating the conditioned air that is directed into comfort zones 70 and 90, respectively. Reheat coil control valves 74 and 94 regulate the flow of a heating medium such as steam or hot water to the respective reheat coils 75 and 95 in response to signals from temperature controller 68 and transducers 71 and 91, respectively. Zone 80 represents an interior zone and is not provided with a reheat coil. During operation of the air conditioning system a decrease in temperature in zone 80 as detected by sensor 88 causes temperature controller 68 to transmit a signal that will modulate supply air damper 83 to a closed or nearly closed position. Conversely, an increase in temperature causes damper 83 to be modulated to an open position. Temperature control in zones 70 and 90 is achieved in a manner similar to that for zone 80 except that dampers 73 and 93 are modulated to a programmed minimum position and then reheat coil control valves 74 and 94 are modulated to increase the flow of heating medium when temperatures in the respective zones fall and to decrease the flow of heating medium when temperatures in the zones rise.

In both FIGS. 1 and 2 it is understood that those devices which are capable of transmitting or responding to electrical signals are provided with appropriate sources of energy to operate the devices.

The foregoing description provides a comprehensive understanding of the present invention. It is apparent, however, that other modifications and changes in the described arrangement can be made without departing from the combination of elements and features disclosed. Such modifications and changes are considered to fall within the scope of the present invention.

What is claimed is:

1. A variable air volume air conditioning system for maintaining a conditioned zone at predetermined temperature and humidity levels comprising in combination (a) a chamber having an entrance end provided with separate modulated damper means for admitting outside air and return air into the chamber and an exit end for delivering conditioned air to a supply air duct carrying conditioned air to said conditioned zone, (b) spray means positioned within the chamber intermediate the entrance and exit ends for spraying sufficient quantities of water into air moving through said chamber to deliver conditioned air to the supply air duct that is substantially saturated with water vapor and is adjusted to a predetermined temperature, (c) moisture eliminator means positioned within the chamber intermediate the spray means and said exit end for removing droplets of water entrained in the conditioned air, (d) variable capacity fan means for moving controlled volumes of air through said system per unit of time, (e) sensing means for monitoring the dew point of the conditioned air delivered to the supply air duct and control means associated therewith for modulating the damper means which admit outside air and return air into the chamber, (f) modulated supply air damper means located at the terminus of the supply air duct for admitting conditioned air into said conditioned zone, (g) heating means disposed in the supply air duct adjacent to the supply air damper means for heating the conditioned air, (h) temperature sensing means located in the conditioned zone and control means associated therewith for regulating said heating means and modulating said supply air damper means in response to temperature changes in said conditioned zone, and (i) pressure sensing means located in the supply air duct and control means associated therewith for modulating the capacity of said variable capacity fan and for regulating the quantity of water injected into the air by said spray means as the air moves through said chamber.

2. The system of claim 1 wherein said chamber is provided with a sump in which a plurality of water is maintained for supplying water to said spray means and in which excess spray water is collected, said sump being provided with means for heating and cooling the quantity of water maintained therein.

3. The system of claim 2 wherein the sensing means for monitoring the dew point of the conditioned air comprises a temperature sensor positioned in the quantity of water maintained in the sump and control means associated with said temperature sensor for regulating the means for heating and cooling the quantity of water in the sump and for modulating the separate damper means which admit outside air and return air into the chamber.

4. The system of claim 2 wherein the sensing means for monitoring the dew point of the conditioned air comprises an absolute humidity sensing device adapted to sample continuously the conditioned air delivered to the supply air duct and control means associated with said humidity sensing device for regulating the means for heating and cooling the quantity of water in the sump and for modulating the separate damper means which admit outside air and return air into the chamber.

5. The system of claim 2 wherein said spray means includes at least two spray nozzle assemblies, separate spray water pumps delivering water to each of said spray nozzle assemblies and control means which provide for operation of only one of the spray water pumps and its associated spray water assembly during periods of low demand on the system.

6. The system of claim 2 wherein said chamber is provided with a baffle plate positioned in the path of the air moving through the chamber, the location of said baffle plate being immediately upstream of said spray means.

7. The system of claim 1, 2, 3, 4, 5 or 6 wherein the supply air duct is provided with a plurality of terminuses for delivering conditioned air to a plurality of conditioned zones, each of said terminuses having a modulated supply air damper means associated therewith which is responsive to a temperature controller and temperature sensing means located in the conditioned zone.

8. The system of claim 7 wherein at least one of said terminuses is provided with heating means, said heating means being disposed within the supply air duct downstream of said supply air damper means.

9. The system of claim 7 wherein said temperature controller possesses proportional with integral or integral with derivative control capabilities.

10. A method for controlling at predetermined levels the temperature and humidity of air in a conditioned zone comprising the steps of (a) establishing a flow of air through an air treating system that delivers conditioned air to the conditioned zone, said system including an air washer, a supply air duct and a variable capacity fan for moving variable volumes of air through the system per unit of time, (b) spraying a controlled quantity of water into the air as it moves through the air washer to produce a stream of conditioned air that is substantially saturated with water vapor, (c) controlling the dew point temperature of the conditioned air leaving the air washer by regulating the flow of return air withdrawn from the conditioned zone and outside air into the air washer and by adjusting the temperature of the water sprayed into the moving air, (d) controlling the flow and heating of conditioned air passing from the supply air duct into the conditioned zone in response to signals from a temperature sensing device located in the conditioned zone, (e) varying the quantity of water sprayed into the moving air and the volume of air moving through the system per unit of time in response to signals from a pressure sensing device disposed in the supply air duct.

11. The method of claim 10 wherein the dew point temperature of the conditioned air leaving the air washer is controlled by a temperature sensor and controller which maintains the temperature of the water sprayed into the moving air at predetermined levels.

12. The method of claim 10 wherein the dew point temperature of the conditioned air leaving the air washer is controlled by a device which monitors the absolute humidity of the conditioned air delivered to the supply air duct.

13. The method of claim 10, 11 or 12 wherein the conditioned air passing through the supply air duct is directed through a plurality of terminuses into a plurality of conditioned zones in response to signals from a temperature sensing device located in each of said conditioned zones.

14. The method of claim 13 wherein the conditioned air directed through at least one of said terminuses is heated in response to signals from a temperature sensing device located in the conditioned zone that is receiving conditioned and heated air from at least one of said terminuses.

* * * * *

UNITED STATES PATENT AND TRADEMARK OFFICE

CERTIFICATE OF CORRECTION

PATENT NO. : 4,540,118

DATED : September 10, 1985

INVENTOR(S) : Richard P. Lortie; William R. Adams

It is certified that error appears in the above—identified patent and that said Letters Patent is hereby corrected as shown below:

On the abstract page under references cited, the following U.S. patents should be listed immediately below the listing for 2,120,299:

| | | | |
|---|---|---|---|
| 4,347,712 | 9/1982 | Benton et al. .... | 62/175 |
| 4,399,864 | 8/1983 | Lamar ..... | 165/20 |

Signed and Sealed this

*Fourth* Day of *March 1986*

[SEAL]

*Attest:*

DONALD J. QUIGG

*Attesting Officer*

*Commissioner of Patents and Trademarks*